US008505142B2

(12) United States Patent
Erlich

(10) Patent No.: US 8,505,142 B2
(45) Date of Patent: Aug. 13, 2013

(54) POOL CLEANER BASEPLATE WITH INLET EXTENSION MEMBERS AND RECESSED WHEELS

(75) Inventor: Giora Erlich, North Caldwell, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 1104 days.

(21) Appl. No.: 12/283,490

(22) Filed: Sep. 11, 2008

(65) Prior Publication Data

US 2010/0058546 A1 Mar. 11, 2010

(51) Int. Cl.
*E04H 4/16* (2006.01)

(52) U.S. Cl.
USPC ..... 15/1.7

(58) Field of Classification Search
USPC ..... 15/1.7
See application file for complete search history.

(56) References Cited

U.S. PATENT DOCUMENTS 5,105,496 A * 4/1992 Gray et al. ..... 15/1.7
5,634,229 A * 6/1997 Stoltz ..... 15/1.7
7,293,314 B2 * 11/2007 Henkin et al. ..... 15/1.7

* cited by examiner

*Primary Examiner* — Randall Chin
(74) *Attorney, Agent, or Firm* — Abelman, Frayne & Schwab

(57) ABSTRACT

A baseplate for a robotic self-propelled pool cleaner having one or more inlet openings through which water-borne debris passes prior to filtration is provided with downwardly depending inlet extension members having walls that define an opening corresponding in shape to the baseplate inlet opening and that are mounted in close-fitting relation to extend the water intake opening towards, but without touching, the pool surface to increase the suction force at the surface. The baseplate optionally includes a rotatable wheel mounted in an inboard recess in the baseplate on, or adjacent to the longitudinal centerline of the cleaner to facilitate passage over obstacles that would immobilize the pool cleaner by contact with an inlet extension member.

20 Claims, 6 Drawing Sheets

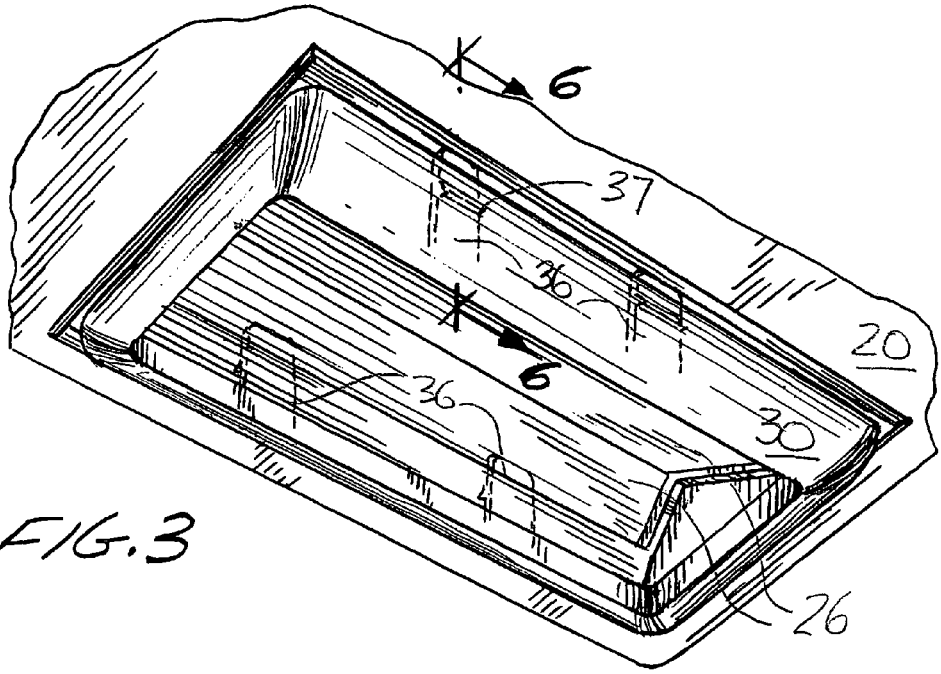
FIG. 3
FIG. 4
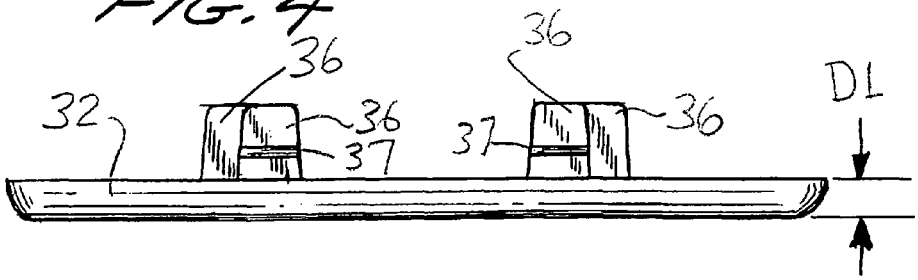

FIG. 5
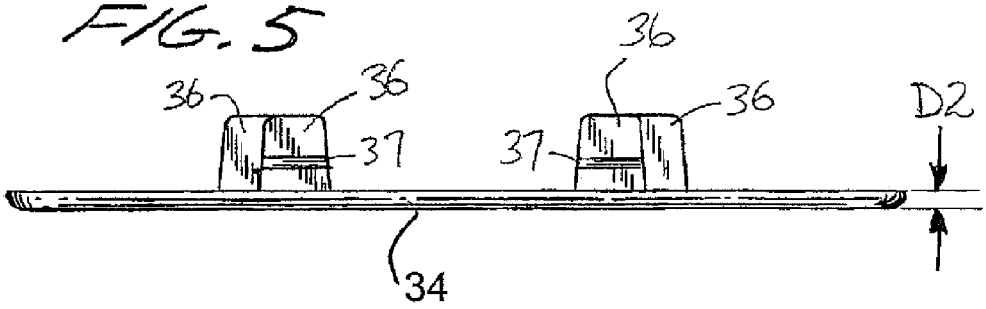
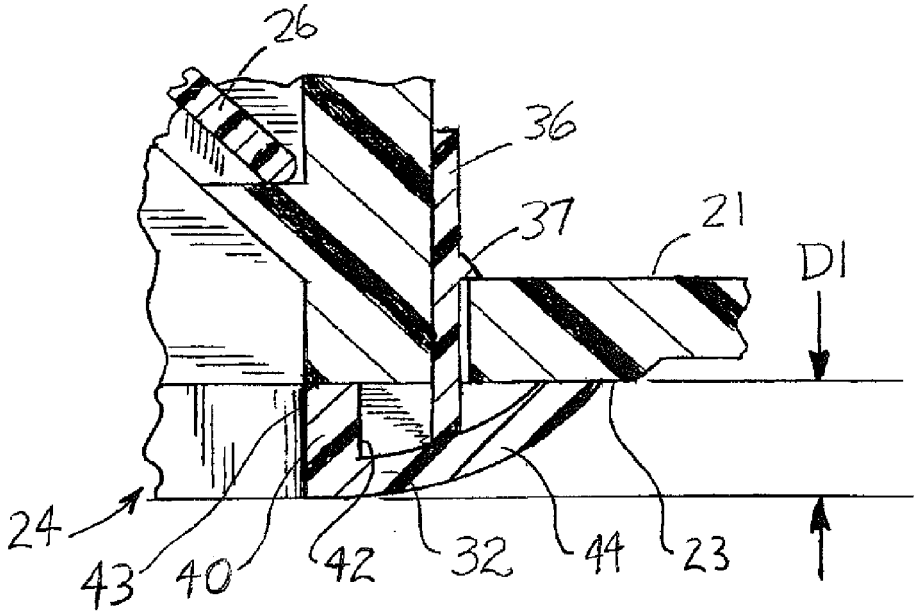
FIG. 6

POOL CLEANER BASEPLATE WITH INLET EXTENSION MEMBERS AND RECESSED WHEELS

FIELD OF INVENTION

This invention relates to robotic self-propelled submersible pool and tank cleaners.

BACKGROUND OF THE INVENTION

Automated or robotic swimming pool cleaners traditionally contact and move about on the pool bottom and wall surfaces being cleaned on four axle-mounted wheels, resilient rollers that are transversely mounted at either end of the unit, or on endless tracks that are powered by a separate drive motor through a gear train to propel the robot over the surfaces of the pool that are to be cleaned. The water pump can drive a water turbine connected via a gear train to the wheels or endless track. Robotic swimming pool cleaners have a pump motor that powers a water pump that draws water through the moving unit and the moving water dislodges and/or "vacuums" debris up into a filter. The water pump can be internal or external to the robotic cleaner. The water exiting the unit having an internal pump in the form of a pressurized stream, or water jet can also be used to move the cleaning apparatus by reactive force.

Automated power-driven pool and tank cleaners are provided with pre-programmed solid state control devices to cause random and/or regular patterns of movement of the apparatus. The purpose of the programmed movement is to maximize the probability that the apparatus will cover the entire bottom and, optionally, the side wall surfaces during the cleaning operation in as little time as possible. An efficient cleaning pattern can also be selected based on the shape and size of the pool.

Often the bottom of a pool or tank has projections or an uneven surface. These obstacles can stop a robotic cleaner or delay the apparatus with much of the directional cycle spent with the apparatus immobilized or diverted from its intended path by a projecting obstacle or pool surface contour. In either case, this is an undesirable result because it lengthens the cleaning time and wastes externally provided electricity or the power of an on-board battery. Furthermore, the obstacle or contour can change the route of patterned travel of the apparatus, thereby reducing cleaning efficiency.

Prior art pool cleaners have addressed the problems of obstacles and extreme surface contours. One prior art method is to reverse and/or change direction of the apparatus when its intended forward movement is prevented. For example, U.S. Pat. No. 6,758,226 to Porat describes an automatic power-driven pool cleaning apparatus in which a motion translation member contacts the surface being cleaned and an associated signal transmitter and a motion sensor is connected to the pool cleaner's electronic control device. When the cleaner is moving, the motion results in a predetermined signal pattern and when the cleaner stops, the signal pattern is interrupted. After a predetermined period of time, the control device causes the cleaner's drive means to move the cleaner in a different direction. The obvious drawback is that the regular pattern of travel is changed thereby potentially reducing the efficiency of the cleaning apparatus.

Another solution to the problem of obstacles is to raise the baseplate by employing larger diameter wheels or supporting propulsion rollers, or by providing adjustable mounting means so that the user can change the distance between the underside of the baseplate and the pool surface depending upon the specific conditions present in the pool. However, pool cleaners remove dirt and debris from surfaces traversed by applying a suction force proximate to the surface to be cleaned to draw debris that rests on, or that is suspended close to the surface beneath the apparatus through openings in the baseplate and into a filter. The interior edge of the inlet opening is preferably near or on the longitudinal center axis running along the baseplate. Since the suction force diminishes rapidly with an increase in distance between the surface being cleaned and the baseplate inlet openings, merely raising the baseplate is not a practical solution to the problem of obstacles that project from the bottom or sidewall of the pool.

It would therefore be desirable to provide a method and apparatus for cleaning the bottom and side walls of pools and tanks that have projecting surface obstacles or extreme contours without stopping or significantly interrupting or altering the cleaning pattern of a self-propelled robotic cleaner.

It would also be desirable to provide a means for easily and economically increasing the suction force for existing pool cleaning apparatus in order to provide an improved degree of cleaning for different types of pool surfaces.

SUMMARY OF THE INVENTION

The above objects and further advantages are achieved by providing one or more inlet extension members that are securely positioned on the exterior surface of the baseplate surrounding each inlet to thereby lower the water intake or suction point of the cleaner. The extension member has walls that define an opening corresponding in shape and size to the baseplate inlet opening and preferably includes projecting mounting members that engage the periphery of the inlet opening to secure the extension member to the baseplate in close-fitting relation so that water will enter the lower open end of the extension member and thereby lower the intake suction point below the baseplate. The downwardly depending walls of the extension member terminate in a rim portion, the rim extending below the baseplate towards, but without touching the pool surface over which the pool cleaner moves during its normal operation. As will be understood by one of ordinary skill in the art, the optimum or maximum depth of the walls is determined by the particular conditions present in the pool or tank in which the cleaner will be operating. As used herein, the term "depth" of the inlet extension member means the vertical distance between the surface of the baseplate and the surface of the rim.

In accordance with the invention, interchangeable inlet extension members are positioned on the baseplate to decrease the distance between the inlet opening and the surface of the pool that is being cleaned. Since suction force increases with decreasing distance between the rim of the extension member and the surface being cleaned, inlet extension openings closer to the surface being cleaned increase the efficiency of lifting and moving debris.

In one preferred embodiment where the baseplate has at least two inlet openings spaced apart along the central longitudinal axis of the baseplate in the direction of movement and offset on either side of the axis, each of the inlet openings is fitted with an extension member of the same depth.

In an especially preferred embodiment, the invention comprises a kit that includes a plurality of extension members of different depths, and in numbers and sizes corresponding to the number of inlet openings in the baseplate of a specific make and model of an existing commercial pool cleaner. For example, in a pool cleaner having a baseplate with two inlet openings, the kit contains two or more pairs of extension members, each pair of different depths and having an opening that is essentially the same as the inlet of the baseplate.

In yet another preferred embodiment, a kit consisting of a replacement baseplate and two or more pairs of interchangeable extension members of different depths is provided for use with pre-existing commercial pool cleaners having removable baseplates. The purpose of this baseplate replacement kit is to enable users to obtain the benefits of the extension members on pool cleaners which are constructed in such a manner that the extension members of the invention cannot be retrofitted due to the design of the inlet opening and/or the presence of the movable closures that operate when the movement of water through the inlet opening is started or stopped.

Since the user of the pool cleaner will preferably have the option of inserting and removing inlet extension members in order to determine which depth provides the best solution to the pre-existing surface conditions, including the particular type of pool surface, the existence of obstacles and extreme changes in contour, the ability to interchangeably insert and remove the extension members is a significant advantage of the invention.

In another embodiment, a baseplate formed by molding a polymeric composition is integrally formed with depending inlet extension members of predetermined depth. Interchangeable baseplates having integrally molded extension members of various depths can be inventoried and made available to purchasers for use with pools having known surface obstructions or conditions.

As will also be apparent to one of ordinary skill in the art, the extension members can be sold in kit form for installation using flush mounting means of attachment, including various types of adhesives and mechanical fasteners, e.g., threaded screws. For example, inlet extension members of the same, or approximately the same interior configuration as the inlet opening, can be provided with a mounting tape having release paper that is removed by the user to enable the extension member to be pressed into position around the inlet opening on the external surface of the baseplate. Although this type of mounting tape, when properly selected for the conditions in the pool, can provide a reliable long-term means of attachment, the use of mounting tape also permits the extension member to be removed, e.g., by the insertion of a knife blade or application of a liquid solvent to separate the extension member from its attachment to the baseplate. By using appropriate solvents and/or scraping tools, any remaining adhesive material can be removed from the baseplate and an inlet extension member of the different depth installed.

In yet another embodiment, the kit can include a number of inlet extension members corresponding in size and number to the inlets in the baseplate, where each inlet member is formed from a plurality of stackable, snap-fit or otherwise interlocking members that permit the user to vary the depth by changing the number of stackable elements. In a particularly preferred embodiment of this aspect of the invention, the lowermost element is configured to provide a rim surface that will promote laminar flow of the incoming water and minimize turbulence to thereby achieve the optimum efficiency in the flow pattern into the inlet opening. Mounting of the stackable elements can be by use of adhesive means or interlocking brackets that engage the baseplate in accordance with the structures described above for the unitary elements.

In yet another embodiment, an extension member is of adjustable depth and constructed of, e.g., close-fitting, interlocking telescoping tubular sections that permit the user to adjust the depth to suit the conditions present in the pool. A wide variety of adjustable constructions are known to those of ordinary skill in the art, as will be their adaptation to the use described above. Set screws and the like can be utilized to maintain one or more telescoping segments in a fixed, but variably adjustable position.

As will be understood from the earlier description, extending the suction point below the baseplate can increase the potential for contact with obstacles projecting from the surface being cleaned or engagement with extreme surface contours. In order to obviate this problem, in a further preferred embodiment, the baseplate includes at least one wheel mounted for rotation in a recess positioned adjacent the inlet opening extension member. In an especially preferred embodiment the wheel is displaced inwardly from the lateral edges of the baseplate.

In an alternate embodiment, two wheels are mounted for rotation in each recess in the baseplate.

In yet another embodiment, the width of the at least one wheel is at least one-quarter of the length of the inlet opening and has the appearance and effect of a roller.

BRIEF DESCRIPTION OF THE DRAWINGS

The invention will be described in detail below and with reference to the attached drawings in which:

FIG. 3 is an enlarged bottom perspective view of a portion of the baseplate of FIG. 2 showing the installation of the inlet extension member of FIG. 4;

FIG. 4 is a side view of one embodiment of an inlet extension member of the invention.

FIG. 5 is a side view of another embodiment of an inlet extension member of the present invention;

FIG. 6 is an enlarged side view, partially in cross-section, showing a mounting detail of a portion of the inlet extension member of FIG. 3 taken along line 6-6;

DETAILED DESCRIPTION OF THE INVENTION

Figure 1:
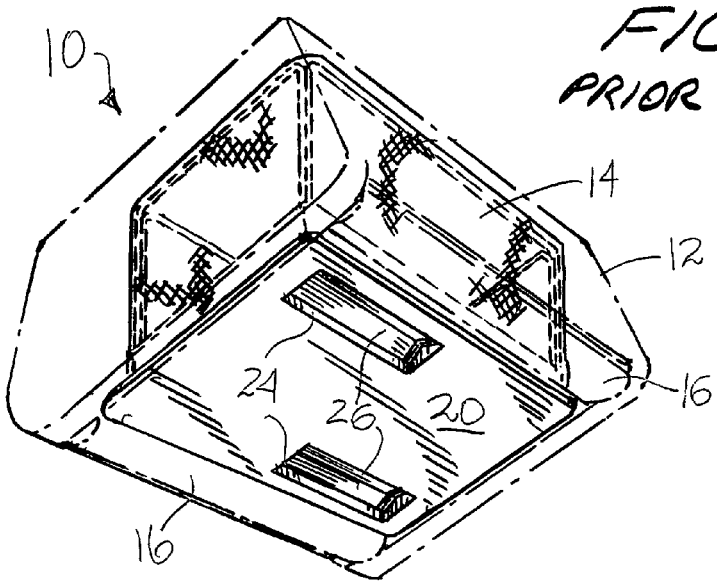
FIG. 1 PRIOR ART
FIG. 1 is a bottom perspective view of a baseplate of the prior art in position on a pool cleaner, the later being shown in phantom.

Referring to FIG. 1, a representative self-propelled robotic pool cleaner 10 of the prior art has an exterior housing 12, an internal filter assembly 14, transverse power driven rollers 16 and a baseplate 20 is schematically depicted. Baseplate 20 is attached to the bottom of the housing 12 and, as illustrated, has two inlet openings 24 that are closed by a pair of biased doors 26 that close when the water flow to the filter is stopped.

Figure 2:
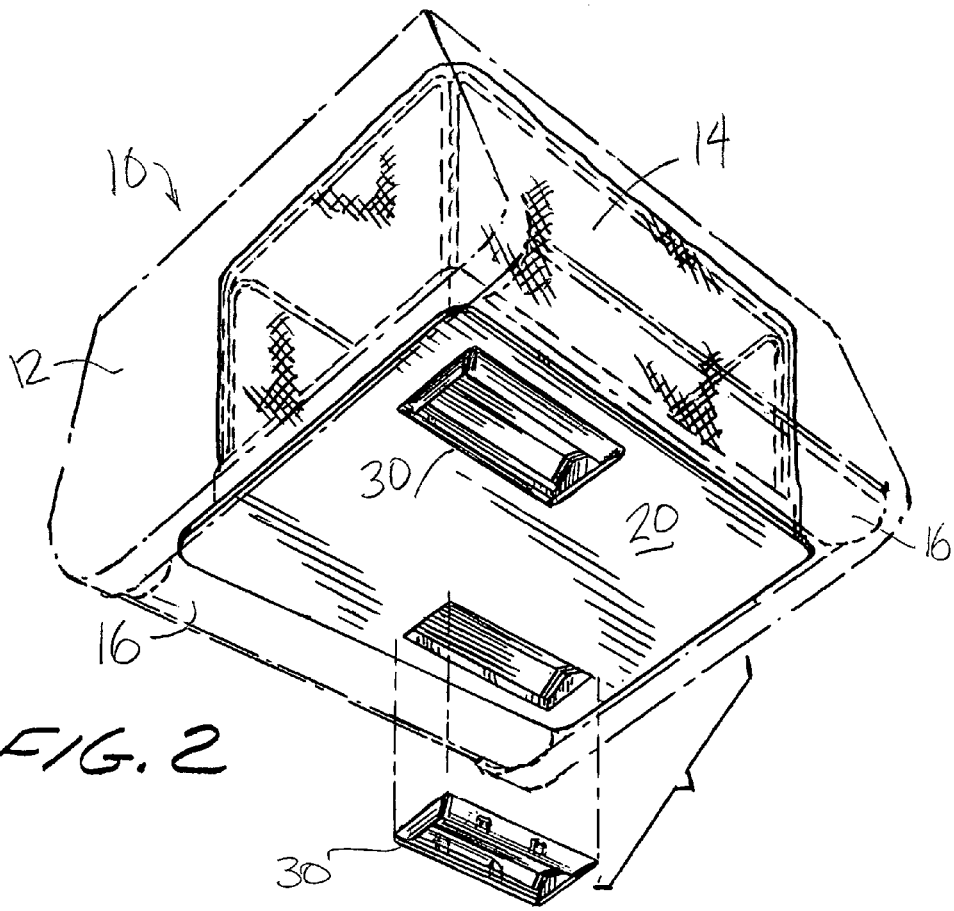
FIG. 2 is a view of a baseplate similar to FIG. 1, showing inlet extension members of the present invention attached and in position for mounting on the baseplate.

Referring now to FIG. 2, the baseplate 20 has been fitted with an inlet extension member, referred to generally as 30, that is assembled in a snap-fitting relation; a second inlet extension member is shown in position for attachment to the baseplate. As most clearly shown in FIGS. 3, 4 and 5, the inlet extension member 30 is formed with a plurality of upwardly projecting members, e.g., clips 36 that are semi-flexible and provided with projecting elements, e.g., ridges 37 that engage the baseplate.

FIGS. 4 and 5 are side views of two inlet extension members 32, 34 of different depths D1 and D2, respectfully, where "D" generally represents the depth that the inlet extension member 30 extends below the exterior surface of the baseplate 20.

The lesser depth of inlet extension member 34 raises the suction point of the cleaning apparatus closer to the baseplate 20. The use of an inlet extension member having lesser depth can be beneficial in situations where, for example, obstacles project higher from the surface to be cleaned and would otherwise immobilize or significantly divert the pool cleaner from its intended programmed movement pattern by contacting the rim of the inlet extension member.

Referring now to FIG. 6, there is shown a cross-sectional view of the inlet extension member 32 viewed along the section line 6-6 of FIG. 3. The extension member 32 (or 34) is removable from the baseplate 20 and includes at least one wall 40 having an outer surface 42 and inner surface 43, where the outer surface 42 is configured to correspond in size and shape to the baseplate water inlet opening 24 formed through the baseplate 20 of the pool cleaner 10. The inner surface 43 of the at least one wall 40 defines an extended inlet for drawing the pool water through the baseplate inlet extension member 32. The at least one wall 40 extends substantially perpendicular from the substantially planar exterior surface 23 of the baseplate 20 towards the distally adjacent pool surface over which the pool cleaner 10 moves during nomial operation and terminates in a rim portion 44. As shown in FIGS. 3 and 6, the rim portion 44 extends radially outwards to define a flange which circumscribes the baseplate water inlet opening 24. Preferably, the outwardly extending flange of the rim portion is curved from the inner surface 43 or outer surface 42 of the wall 40 towards the planar exterior surface 23 of the baseplate 20. In FIG. 5, the extension member 34 illustratively has a predetermined depth of "D2", whereas referring to FIGS. 4 and 6, the extension member 32 has a depth of "D1". Installing an extension member having a predetermined depth, e.g., D1 or D2, is based on the surface conditions of the pool and the amount of suction desired, as described below in further detail. The projecting elements 37 (e.g., ridges) engage the interior surface 21 of baseplate 20. In a preferred embodiment, the projecting member 36 (e.g., clip) is sufficiently flexible to permit its disengagement and removal.

Figure 7:
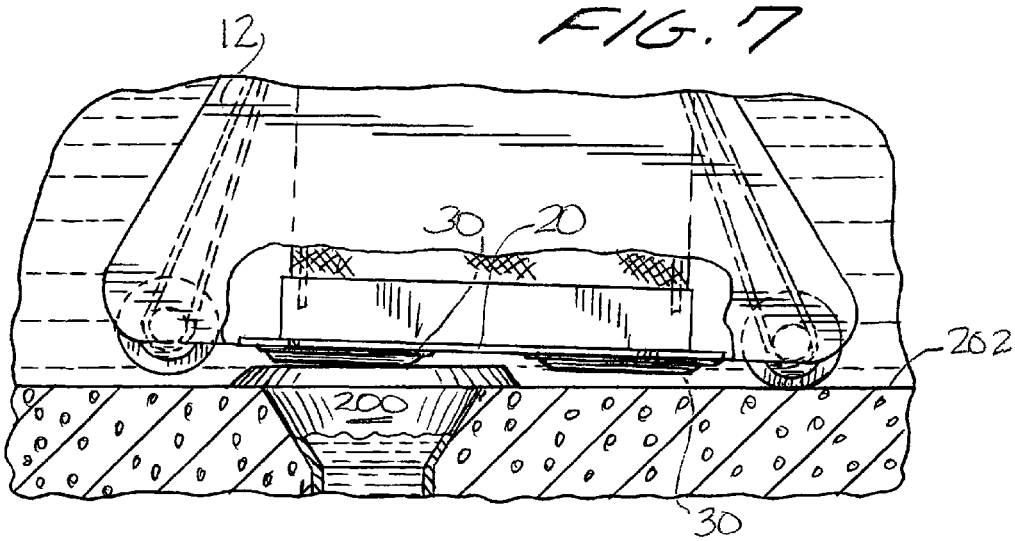
FIG. 7 is a side elevation view of a portion of a pool cleaner immobilized by an inlet extension member contacting an obstacle projecting from the pool surface being cleaned.

As shown in the illustration of FIG. 7, the lower rim surface of inlet extension member 30 can project sufficiently below baseplate 20 that it comes into frictional contact with obstacles projecting above the surface 202 of the pool that is being cleaned. As shown, a water inlet cover 200 projects above pool surface 202 and the pool cleaner 10 is immobilized as a result of one or both of rollers 16 making insufficient frictional contact to maintain the movement of the unit.

Figure 8:
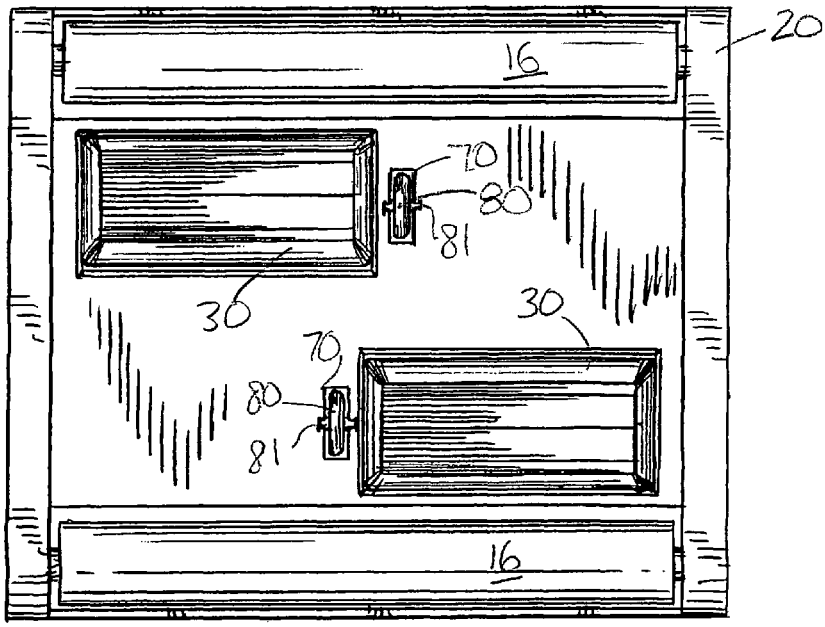
FIG. 8 is a bottom view of a swimming pool cleaner and baseplate with inlet extension members and wheel recesses of the present invention.

In order to remedy this problem where the pool cleaner is used in pools having obstacles projecting from the surface being cleaned, the baseplate is provided with one or more recesses for receiving axle-mounted wheels. Referring now to FIG. 8, recesses 70 are positioned adjacent the inlet extension members 30 and a wheel 80 mounted on an axle 81 is secured for rotation in each recess.

Figure 9:
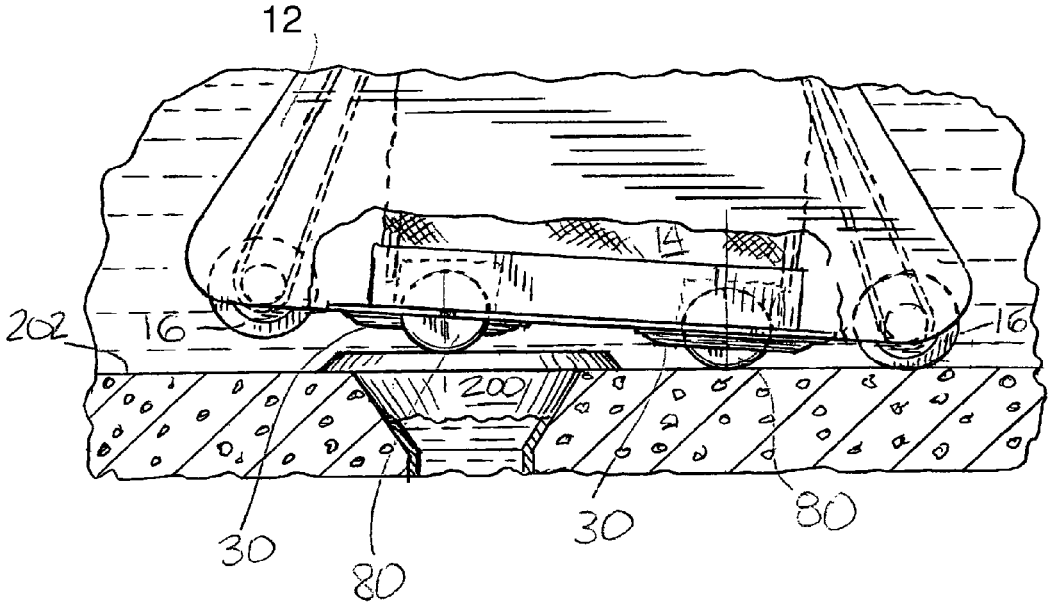
FIG. 9 is a view similar to that of FIG. 7 showing the pool cleaner equipped with the recessed wheels of the present invention rolling over the obstacle.

As best shown in FIG. 9, the wheels 80 project at least to the depth of the extension member 30, and preferably slightly deeper below the baseplate. This enables the pool cleaner 10 to ride up and over the projecting obstacle 200, thereby avoiding the immobilization and/or the diversion of the unit from its programmed cleaning pattern.

The axle-mounted wheels are preferably removably mounted in the recess 70. This can be accomplished by various mechanical fastening techniques that will be apparent to one of ordinary skill in the art, including molding channels in the baseplate that communicate with the recess and into which one or both of the opposing ends of the axle can be inserted in a releasable snap-fit relation; or by a mechanical fastener, e.g., a screw and optionally a bracket that retains the free end of the axle in position. This arrangement allows the user to determine whether a wheel is necessary and, if so, the option of selecting a wheel, or set of wheels, of a diameter that is appropriate for the height of projecting obstacles present in the pool. In this manner, the user can customize the pool cleaner based upon the conditions present in the pool.

In a particularly preferred embodiment, the recesses 70 are large enough to accommodate wheels of various diameters and the wheels are either sold to the user as a kit or by a supplier who maintains an inventory from which the user can select the appropriate sized wheels and accompanying inlet extension members 30.

As shown in the embodiment of FIG. 8, wheels 80 can be on opposite sides of the longitudinal centerline of the pool cleaner. These offset wheels permit the pool cleaner to ride over obstacles and prevent the apparatus from being immobilized on a pool drain cover or other protrusions from a surface over which the apparatus is traveling.

Again, with reference to FIG. 9, the wheels 80 roll over the projecting surface obstacle, e.g., pool drain cover 200 by preventing the inlet extension member 30 from contacting the obstacle. Referring to FIG. 9, it will also be understood that the wheels 80 can extend the same distance or less than the distance from the baseplate 20 as rollers 16, or other drive means that support the pool cleaner for movement.

Figure 10:
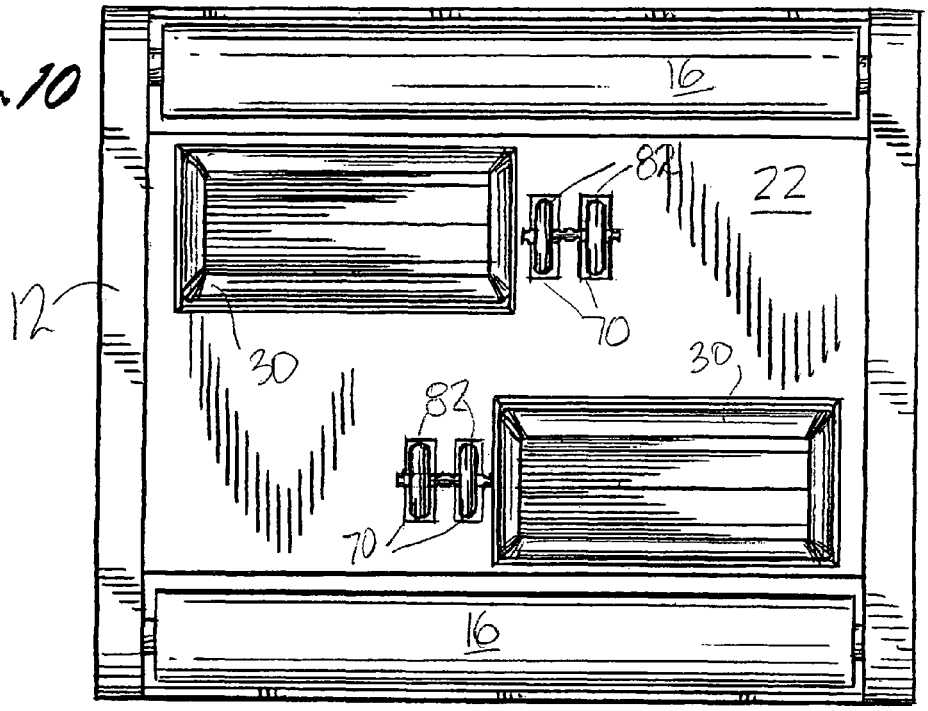
FIG. 10 is a bottom view similar to FIG. 8 showing another embodiment of the recessed wheels of the invention.

FIG. 10 illustrates an alternate embodiment of the invention shown in FIG. 8, where a set of two wheels 82 are positioned in each of two sets of separate wheel recesses 70 positioned on opposite sides of the baseplate center line and adjacent the respective inlet extension members 30.

Figure 11:
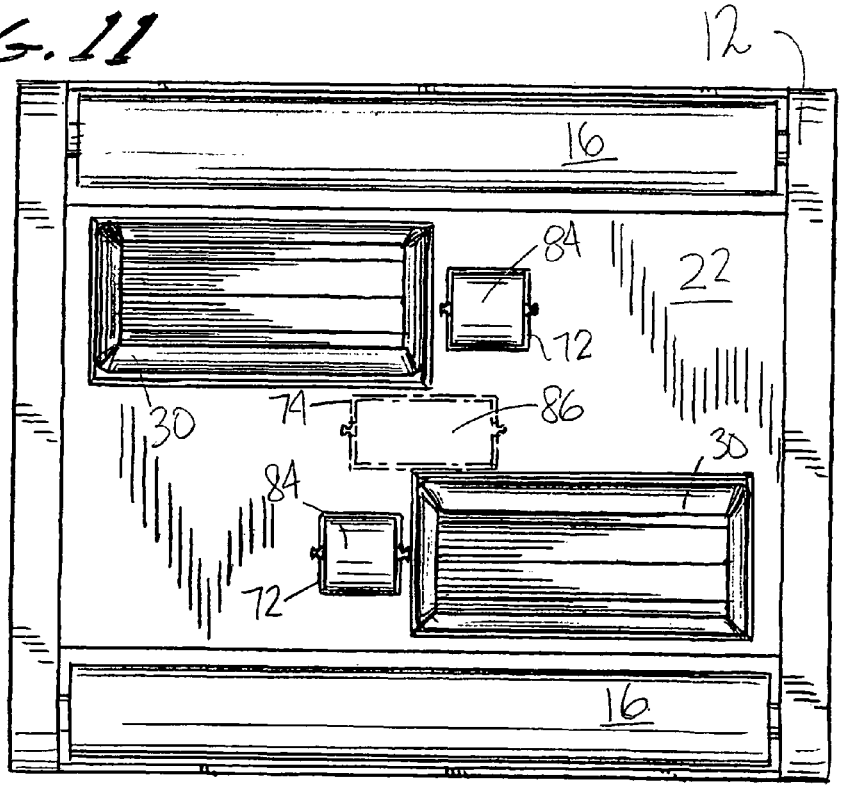
FIG. 11 is a bottom view similar to FIG. 8 showing yet another embodiment of the recessed wheels of the invention.

As shown in FIG. 11, the baseplate can also be configured so that a large recess 72 replaces each of the pair of recesses 70 shown in FIG. 10 so that a single roller 84, or two or more wheels (not shown) are mounted for rotation in each of the large recesses.

As also shown in phantom in FIG. 11, a single large recess 74 is centrally positioned between the two inlet extension members 30 to accommodate a single larger roller 86, or a plurality of wheels (not shown) mounted on a single releasable axle.

As previously explained, in order to optimize the position of the inlet opening and to maximize the amount of suction force to remove debris from the surface being cleaned, the present invention provides interchangeable inlet extension members which can be used to lower the suction point relative to the surface being cleaned. The interchangeable extension members can also be used to decrease the effective area of the suction openings to thereby increase the velocity of the water drawn into the inlet opening. When used in combination with the recessed wheels, the inlet extension members provide improved cleaning efficiency, even in pools having surface obstacles that could otherwise interfere with the patterned movement of the cleaner.

While the foregoing is directed to various embodiments of the present invention, additional embodiments will be apparent to those of ordinary skill in the art without departing from the basic principles and the scope of the invention is to be determined by the claims that follow.

I claim:

1. A baseplate inlet extension member for a self-propelled robotic pool cleaner having a baseplate with a substantially planar exterior surface and one or more water inlet openings, the baseplate inlet extension member comprising:

at least one wall having an outer surface and an inner surface, the at least one wall configured in size and shape to a correspondingly configured one of the water inlet openings formed in the baseplate of the pool cleaner;

the at least one wall of the baseplate inlet extension member extending substantially perpendicular from the substantially planar exterior surface of the baseplate in a direction towards a distally adjacent pool surface over which the pool cleaner moves in normal operation and terminating in a rim portion that defines an outwardly extending flange to engage the exterior surface of the baseplate when the extension member is positioned in the corresponding inlet opening, wherein the inner surface of the at least one wall defines an inlet extension that extends from the exterior surface of the baseplate for drawing water through the baseplate inlet extension member; and the rim portion including one or more projecting clips extending in a direction towards the planar exterior surface of the baseplate, each projecting clip having at least one outwardly extending mounting member which engages the baseplate water inlet opening, the baseplate inlet extension member having a predetermined depth to avoid contacting the distally adjacent pool surface during normal operation of the pool cleaner.

2. The baseplate inlet extension member of claim 1, wherein an exterior surface of the outwardly extending flange is curved.

3. The baseplate inlet extension member of claim 1, wherein the at least one mounting member is configured to engage the baseplate in snap-fit relation to removably secure the baseplate inlet extension member to the baseplate.

4. The baseplate inlet extension member of claim 1 which is comprised of a plurality of interlocking stackable elements, wherein the depth of the baseplate inlet extension member is changeable by adding or removing one or more elements.

5. The baseplate inlet extension member of claim 1 in which the at least one wall comprises a plurality of close-fitting telescoping elements that are adjustably extensible.

6. The baseplate inlet extension member of claim 1 which includes adhesive mounting means having an adhesive surface covered by a removable protective web.

7. The baseplate inlet extension member of claim 1, wherein the one or more projecting clips extend substantially parallel to the at least one wall.

8. The apparatus of claim 1, wherein the predetermined depth of the baseplate inlet extension member is defined by a length of the at least one wall forming the inlet extension.

9. An apparatus for defining a bottom portion of a submersible robotic self-propelled pool cleaner, comprising:

a baseplate having a planar exterior surface and at least one inlet opening through which water-borne debris passes prior to filtration; and at least one inlet extension member that extends in a direction towards a distally adjacent pool surface over which the pool cleaner moves during normal operation, the at least one inlet extension member being removably secured in close-fitting relation to the baseplate at the at least one inlet opening, the at least one inlet extension member including at least one wall having an outer surface and an inner surface, the at least one wall configured generally in size and shape to a correspondingly configured one of the at least one inlet opening;

the at least one wall terminating in a rim portion that defines an outwardly extending flange to engage the exterior surface of the baseplate when the extension member is positioned in the corresponding inlet opening wherein the inner surface of the at least one wall defines an inlet extension that extends from the exterior surface of the baseplate for drawing water through the baseplate inlet extension member; and the rim portion including one or more projecting clips extending in a direction towards the exterior surface of the baseplate, the one or more projecting clips including at least one outwardly extending mounting member which engages the baseplate water inlet opening, the inlet extension member having a predetermined depth to avoid contacting the distally adjacent pool surface during normal operation of the pool cleaner.

10. The apparatus of claim 9, wherein the one or more projecting clips engage the periphery of the inlet opening to secure the extension member to the baseplate.

11. The apparatus of claim 9, wherein the baseplate includes two inlet openings spaced apart on opposing sides of a central longitudinal axis of the baseplate, and wherein the inlet openings are offset from each other on either side of said axis.

12. The apparatus of claim 9 in which the at least one inlet extension member includes a plurality of inlet extension members of the same depth.

13. The apparatus of claim 9, wherein the exterior surface of the baseplate is fitted with at least two interchangeable inlet extension members.

14. The apparatus of claim 9, further comprising at least one wheel mounted for rotation in a wheel recess formed in the baseplate, said at least one wheel being positioned adjacent to the at least one inlet opening and displaced inwardly towards a central longitudinal axis of the baseplate.

15. The apparatus of claim 14, wherein an outer end portion of the at least one inlet opening extends transversely from a position proximate one lateral edge of the baseplate and terminates with an interior end portion that is on, or adjacent to the central longitudinal axis of the baseplate, and the wheel recess is positioned between the interior end portion of the opening and the opposite lateral edge of the baseplate.

16. The apparatus of claim 14 in which two wheels are mounted for rotation in the same or separate adjacent recesses.

17. The apparatus of claim 14 in which the at least one wheel is removably secured for rotation in its recess.

18. The apparatus of claim 9, wherein the one or more projecting clips extend substantially parallel to the at least one wall.

19. The baseplate inlet extension member of claim 9, wherein the predetermined depth of the inlet extension is defined by a length of the at least one wall forming the inlet extension.

20. A plastic baseplate for a self-propelled robotic pool cleaner, the baseplate having an upper surface and a lower surface and being formed from a polymeric material, said baseplate having at least one inlet opening that includes a downwardly depending inlet extension member that is integrally formed with the baseplate, the downwardly depending extension member having at least one wall extending substantially perpendicular to the upper and lower baseplate surfaces and defining the at least one inlet opening for drawing water therethrough, the at least one wall terminating in a rim portion along the lower surface of the baseplate, the rim portion having an outwardly extending flange that circumscribes the at least one water inlet and having a predetermined depth below the lower surface of the baseplate, wherein the baseplate is configured and dimensioned for removable mounting on the pool cleaner.

* * * * *